United States Patent [19]

Kaufmann

[11] Patent Number: 4,499,925

[45] Date of Patent: Feb. 19, 1985

[54] HOSE-LIKE SEAL DEVICE FOR CONCRETE JOINTS

[75] Inventor: Peter Kaufmann, Immensee, Switzerland

[73] Assignee: Aquarius für Dichte Bauten AG, Kirchberg, Switzerland

[21] Appl. No.: 442,751

[22] Filed: Nov. 18, 1982

Related U.S. Application Data

[63] Continuation-in-part of Ser. No. 232,515, Feb. 9, 1981, abandoned.

[30] Foreign Application Priority Data

Mar. 5, 1980 [CH] Switzerland ..... 1738/80

[51] Int. Cl.[3] ..... F16L 11/12

[52] U.S. Cl. ..... 138/125; 138/97; 285/15

[58] Field of Search ..... 138/97, 98, 99, 125, 138/124, 126; 229/93; 264/35, 36; 285/15; 277/34, 72 FM; 52/309.5; 404/74; 249/65, 113

[56] References Cited

U.S. PATENT DOCUMENTS

| | | | |
|---|---|---|---|
| 231,736 | 8/1880 | Taylor | 138/125 |
| 1,285,138 | 11/1918 | Hansen | 158/124 |
| 1,396,060 | 11/1921 | Richter et al. | 229/93 |
| 1,925,538 | 9/1933 | Knopp | 138/97 |
| 2,915,110 | 12/1959 | Ferguson . | |
| 2,930,408 | 3/1960 | Stevens | 229/93 X |
| 3,462,521 | 8/1969 | Bini | 264/35 X |

FOREIGN PATENT DOCUMENTS

| | | | |
|---|---|---|---|
| 600077 | 6/1978 | Switzerland | 138/97 |
| 1065922 | 4/1967 | United Kingdom . | |
| 1116835 | 6/1968 | United Kingdom . | |

OTHER PUBLICATIONS

Peduzzi, A., "Abdichtungen im Tunnel-und Stollenbow", Kaspar Winkler & Co., pp. 7–9.

*Primary Examiner*—James E. Bryant, III

*Attorney, Agent, or Firm*—Werner W. Kleeman

[57] ABSTRACT

A mesh hose bears upon a liquid pervious, for instance helical-spring shaped support body, and upon such mesh hose there lies a paper-like hose. This structure is loosely placed in an external mesh hose portion. The paper-like hose can be impregnated. If such sealing device is placed with closed ends into a concrete joint, which then is to be closed with concrete, the sealing device then can be drilled from the outside through the concrete and filled with a sealing compound or agent which penetrates through the wall of the device into untight or leaky concrete locations and can seal the same. The paper-like hose successfully prevents the clogging of the device by concrete grout or the like.

6 Claims, 4 Drawing Figures

HOSE-LIKE SEAL DEVICE FOR CONCRETE JOINTS

CROSS REFERENCE TO RELATED APPLICATION

This application is a continuation-in-part application of my pending United States application Ser. No. 232,515, filed Feb. 9, 1981, now abandoned.

BACKGROUND OF THE INVENTION

The present invention relates to a new and improved construction of a hose-like sealing device for concrete joints.

Generally speaking, the hose-like sealing device for concrete joints of the invention is of the type comprising an inner support body possessing a liquid pervious wall, a first fluid pervious meshwork-like hose encapsulating such support body, and a second liquid pervious, meshwork-like hose which encapsulates or surrounds the first hose.

Such type of sealing device is known to the art from Swiss Pat. No. 600,077, granted Dec. 15, 1977. In contrast to conventional joint sealing bands it possesses the advantage that it is possible to introduce the sealing agent therethrough into the concrete of the joint region, something which previously was attempted without success by means of perforated plastic hoses. In this respect, attention is directed to the supplement to volume 9 of the publication "Schweizer Baublatt", dated Feb. 3, 1976, and entitled "Kunstoffe im Bau". Therefore, partial success was realized with the sealing device of the aforementioned Swiss Patent No. 600,077 in terms of avoiding the otherwise hardly divertible water circulation of conventional sealing bands.

Yet, even with extremely carefully fabricated and exceptionally well compacted concrete, by subjecting the same to intensive vibrations, it is hardly possible to prevent penetration of concrete constituents into the interior of the sealing device, so that there can arise clogging and hence functional degrading of the sealing device.

SUMMARY OF THE INVENTION

Therefore, with the foregoing in mind, it is a primary object of the present invention to provide a new and improved construction of a hose-like sealing device for concrete joints which is not afflicted with the aforementioned drawbacks and limitations of the prior art discussed above.

Another and more specific object of the present invention aims at overcoming these limitations in an economical manner and, in particular, devising a sealing device of the previously mentioned type which can be used successfully practically under all conditions and which enables fabrication of faultless concrete joint seals.

Now in order to implement these and still further objects of the invention which will become more readily apparent as the description proceeds, the hose-like sealing device for concrete joints of the present development is manifested by the features that between both of the aforementioned network by meshwork-like hoses there is provided a hose-like arranged member.

As already mentioned previously the invention also is directed to a method of fabricating a concrete joint seal, wherein a sealing device of the aforementioned type is at least partially embedded in concrete in a concrete joint and a sealing agent or compound is introduced into the sealing device and through its walls into the concrete.

The particularly helical spring-like support body used in the sealing device forms together with the internal, meshwork-like hose, for instance formed of meshed monofilaments, and which hose surrounds the support body, a solid support for the hose-like arranged member, whereas the second meshwork-like hose, which basically can be similarly constructed as the first-mentioned hose, but should have a greater diameter, affords an effective protection of the hose-like member against mechanical damage in that it safeguards the hose-like member from contact by coarser concrete components or constituents.

If relatively liquidus materials efflux out of the concrete and penetrate through the outer network or meshwork-like hose, then further penetration of such liquidus material can be prevented by the action of the suitably constructed hose-like member. This is particularly the case if the hose-like member is impregnated.

The hose-like member can be applied as a multi-ply structure, for instance by winding it a number of times upon the inner hose. It need not possess any particularly great tear strength, and thus for instance can be a paper-like structure since it is well protected by the support body and the inner meshwork-like hose and from the outside it is well screened by the outer meshwork-like hose. This hose-like member of paper-like structure may be formed of paper, tissue or other non-wovens which as is well known define webs.

The use of a relatively weak paper-like hose member then also can provide the advantage that during the forcing-in of the sealing agent or compound into the sealing device the paper-like hose member enlarges or expands or even tears or ruptures under the action of the forced in sealing agent, and thus, facilitates the escape of the sealing agent.

By virtue of the multi-layer construction of the sealing device there is afforded good flexibility thereof and with suitable design there also can be provided a certain limited lengthwise elongation which, for instance, enables the snug running or placement of the sealing device around pipes or conduits.

Due to its particular "sealing action" during the concrete work, the inventive sealing device also can be employed during the prefabrication of concrete parts where, as is known, there occur particularly intensive sealing operations.

In the case of interruption joints during the concrete work it is possible to apply to the surface which already has been found in concrete, and following which there is subsequently to be formed in concrete a further structural component, a sealing device of the previously mentioned type and, for instance, to secure such to reinforcement iron members, whereupon the concrete work is carried out, and the concrete is permitted to set and contract. It is then possible to drill holes through the concrete into the sealing device and to inject a sealing compound or agent therein which then can penetrate into the concrete at fault locations and seal such fault locations. When encountering center joints it is possible to use a joint band as the same has been described in Swiss Patent No. 600,077, and sealing devices of the type disclosed herein then can be employed.

As the sealing compound or agent it is possible to use a sealing agent which becomes hard after setting, for instance an epoxy resin, or however there can be used a sealing agent or compound which forms a gel following the injection work.

For the purpose of introducing the sealing agent or compound into the concrete it is advantageous if both ends of each sealing device section are closed and overlap an end section of portion of the next sealing device section. In contrast to the heretofore known bands it is therefore not necessary, when practicing the teachings of the invention, that the sealing devices extend over the entire length of the joints. Also this appreciably facilitates the sealing work. This also leads to the fact that an inventive sealing device can be supplied in standardized length sections with closed ends to the construction site and at that location need only be laid and secured.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
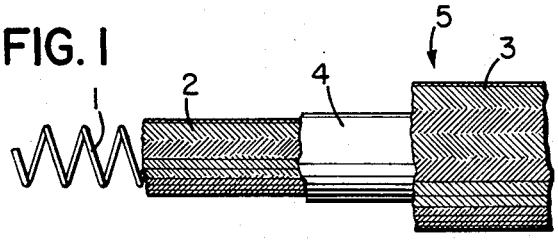
FIG. 1 is a front view of a sealing device according to the invention shown in cutwaway at a number of locations.
Figure 2:
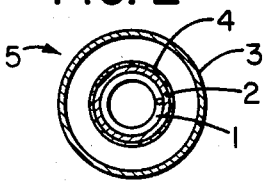
FIG. 2 is a cross-sectional view of the sealing device of FIG. 1.

Describing now the drawings, and turning attention specifically to FIGS. 1 and 2, it will be seen that the exemplary embodiment of seal or sealing device 5 comprises a plurality of essentially cylindrical components, shown coaxially arranged in the mentioned FIGS. 1 and 2, and specifically the support body 1, a meshed hose 2, a paper-like hose 4 defining a sealant throughpassing means and an external meshed hose 3.

In the embodiment under discussion the support body 1 has the configuration of a helical or coil spring possessing a relatively large pitch and advantageously is formed of, for instance, steel. Therefore, the support body 1 is flexible, but still relatively stiff.

Bearing upon the support body 1 is the inner hose 2 which is interwoven or plaited from relatively thick monofilaments, for instance formed of polyamide. This inner hose 2 spans or bridges the intermediate spaces of the windings or coils of the helical spring of the support body 1 and serves as a suppport for the paper-like hose 4. Consequently, the support body 1, the inner meshed hose 2 and the paper-like hose 4 form a relatively stiff but flexible hose structure which ultimately is then enclosed within the essentially wider outer meshed hose 3. This outer hose 3 likewise consists of relatively thick monofilaments which likewise can be formed of, for instance, polyamide.

Of course, the hose or hose member 3 is actually not coaxially oriented with respect to the remaining components because the latter are arranged with play therein.

The paper-like material of the hose 4 forms an approximately water impervious structure as such but can be beneficially impregnated with a substance which imparts thereto sufficient water impermeability, so as to prevent the penetration of cement grout. However, following the concreting work the paper-like hose 4 can be penetrated from the interior thereof a liquid, so that if desired it can be torn or ruptured.

The hose member 4 advantageously may comprise a plurality of mutually contacting layers **4*a*** each formed of a paper-like structure.

The outer meshed hose 3 serves as a protection for the paper-like hose 4 against damage by the concrete. It also should leave a certain amount of space about the paper-like hose 4.

Figure 3:
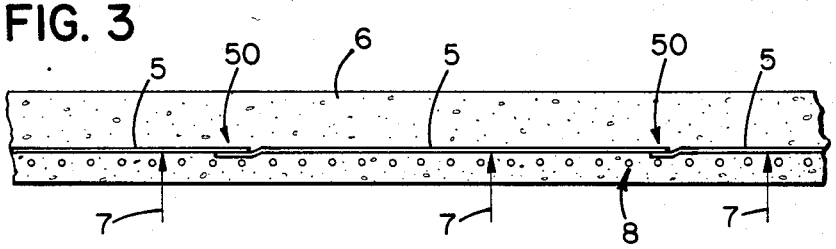
FIG. 3 is a top plan view of an interruption joint at a concrete structure containing the sealing devices of the invention laid therein.
Figure 4:
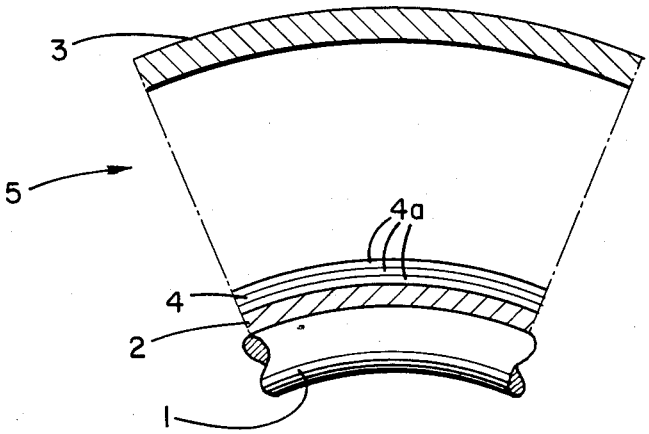
FIG. 4 is an enlarged sectional view showing a detail of the arrangement of FIG. 2.

FIG. 3 shows in top plan view the end of a concrete structure upon which there have been arranged three sections or pieces of sealing devices 5 with overlapping ends 50 and attached by any suitable means to the reinforcement iron elements 8. At the locations indicated by the arrows 7 or also at any other suitable locations, it is possible to drill holes following the concrete work and through which holes it is then possible to introduce, as by injection, a suitable sealing agent or compound into the interior or the relevant sealing device 5. The drilling and injection work need only be undertaken at those locations where the concrete appears to be leaky or untight. It is for this reason that also the use of the sections or portions of the sealing devices 5 is advantageous, and the ends 50 in each case are closed which, for instance, can be conveniently accomplished by fusing the interwoven or meshed hoses 2 and 3.

The sealing device of the invention, by virtue of its flexibility and high transverse stability (it does not tend to buckle or kink and does not collapse) also can be advantageously used as a seal about extended members, for instance as a winding or coiling arrangement about a pipe or conduit.

It is possible to use as the sealing agent, for instance, setting resins or gelling agents.

The sealing agents, which can be injected into the sealing device, penetrate through the wall of the sealing device and enter into the untight concrete locations and reliably seal the same.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A hose-like sealing device for concrete joints, essentially consisting of:

an inner liquid pervious support body;

a first liquid pervious meshed hose member surrounding said support body;

a second liquid pervious meshed hose member surrounding said first hose member; and sealant throughpassing means for passing a liquid sealing agent therethrough;

said sealant throughpassing means comprising a member formed of a paper-like structure arranged in a hose-like fashion between both of said first and second hose members and adapted to be penetrated from the interior towards the outside by said liquid sealing agent.

2. The sealing device as defined in claim 1, wherein:

said member formed of a paper-like structure bears against said first meshed hose member; and said second meshed hose member loosely encapsulating said member formed of a paper-like structure.

3. The sealing device as defined in claim 2, wherein:
said member formed of a paper-like structure comprises a plurality of mutually contacting layers each formed of a paper-like structure.

4. The sealing device as defined in claim 1 wherein:
said member formed of a paper-like structure is impregnated with an impregnation agent which reduces the penetration of cement group into the member formed of a paper-like structure.

5. The sealing device as defined in claim 1, wherein:
said member formed of a paper-like structure is adapted to be easily ruptured under the action of said liquid sealing agent which is forced into the sealing device.

6. A hose-like sealing device for concrete joints, essentially consisting of:
an inner liquid pervious support body;
a first liquid pervious meshed hose member surrounding said support body;
a second liquid pervious meshed hose member surrounding said first hose member; and
sealant throughpassing means for passing a liquid sealing agent therethrough;
said sealant throughpassing means comprising a member formed of a non-woven web arranged in a hose-like fashion between both of said first and second hose member and adapted to be penetrated from the interior towards the outside by said liquid sealing agent.

* * * * *

UNITED STATES PATENT AND TRADEMARK OFFICE

CERTIFICATE OF CORRECTION

PATENT NO. : 4,499,925

DATED : February 19, 1985

INVENTOR(S) : PETER KAUFMANN

It is certified that error appears in the above-identified patent and that said Letters Patent is hereby corrected as shown below:

Column 3, line 7, after "section" please delete "of" (first occurrence) and insert —or—

Column 3, line 25, please delete "cutwaway" and insert —cutaway—

Column 3, line 55, please delete "suppport" and insert —support—

Column 4, line 4, after "thereof" please insert —by—

Column 5, line 9, please delete "group" and insert —grout—

Column 6, line 13, please delete "member" and insert —members—

Signed and Sealed this

*Eighteenth* Day of *June 1985*

[SEAL]

*Attest:*

DONALD J. QUIGG

*Attesting Officer* *Acting Commissioner of Patents and Trademarks*